US006264020B1

(12) United States Patent
Rufener et al.

(10) Patent No.: US 6,264,020 B1
(45) Date of Patent: Jul. 24, 2001

(54) DEVICE WITH A SWIVELLING WING, ESPECIALLY CONSTRUCTED AS A COIN-ACCEPTING DEVICE IN A SELF-COLLECTING VENDING MACHINE

(75) Inventors: Peter Rufener, Kehrsatz; Fritz Siegenthaler, Gumligen, both of (CH)

(73) Assignee: Ascom Autelca AG, Gumligen (CH)

( * ) Notice: Subject to any disclaimer, the term of this patent is extended or adjusted under 35 U.S.C. 154(b) by 0 days.

(21) Appl. No.: 09/237,797

(22) Filed: Jan. 27, 1999

(30) Foreign Application Priority Data

Jan. 27, 1998 (EP) ..... 98810049

(51) Int. Cl.[7] ..... G07F 9/10; E05D 7/14

(52) U.S. Cl. ..... 194/350; 16/271; 220/845

(58) Field of Search ..... 194/350; 16/268, 16/260, 271; 220/810, 845

(56) References Cited

U.S. PATENT DOCUMENTS

| | | | | |
|---|---|---|---|---|
| 699,530 | * | 5/1902 | Jackson | 16/271 |
| 864,690 | * | 8/1907 | Rice | 16/271 |
| 908,100 | * | 12/1908 | Howey | 16/271 |
| 909,436 | * | 1/1909 | Melton | 16/271 |
| 1,915,448 | * | 6/1933 | Ruth | 16/271 |
| 1,924,537 | * | 8/1933 | Bommer | 16/271 |
| 3,922,048 | | 11/1975 | Christianson et al. . | |
| 5,193,308 | | 3/1993 | Davidian . | |
| 5,557,067 | * | 9/1996 | Messelhi | 16/271 |
| 5,724,704 | * | 3/1998 | Seo | 16/271 |
| 5,806,144 | * | 9/1998 | Fries | 16/271 |
| 6,030,064 | * | 2/2000 | Kim | 16/271 X |

FOREIGN PATENT DOCUMENTS

| | | | | |
|---|---|---|---|---|
| 209173 | * | 4/1909 | (DE) | 16/271 |
| 9913363 U | | 11/1990 | (DE) . | |
| 4431628A1 | | 3/1996 | (DE) . | |
| 0337013A2 | | 10/1989 | (EP) . | |
| 2620759 | * | 4/1909 | (FR) | 16/271 |
| 398963 | * | 9/1933 | (GB) | 16/271 |

* cited by examiner

*Primary Examiner*—Eileen D. Lillis
*Assistant Examiner*—Thuy V. Tran

(57) ABSTRACT

The device has a base element (1) and a wing (5) arranged so as to be pivotable on the latter with a swivel joint (3). The swivel joint (3) has two fastening flanges (9, 10) which are pivotable about the swiveling axis (7) for fastening on the base element (1) or on the wing (5). At least one of the fastening flanges (9) has a snap on first holding element **(21*b*, 23*a*) and second holding elements interacting with the first at least on one of the free rim sides of the base element (1) and/or of the wing provided for fastening the swivel joint. With these holding elements, the fastening flange is permanently connectable with the long side of the base element (1)** and/or wing following the following fastening by pressing together. Preferably the device will be constructed as an interchangeable coin-collecting vending machine with a container accepting the coins as a base element and a cover covering the container with a locking facility as a wing, whereby all movable mechanical elements necessary for the locking process as well as all electrical control, monitoring and/or device encoding elements are arranged in the cover, and the container is merely constructed as a passive component.

19 Claims, 2 Drawing Sheets

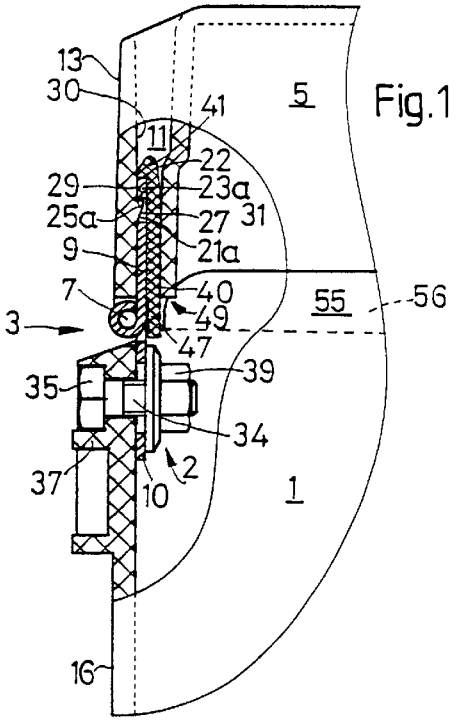
Fig.1
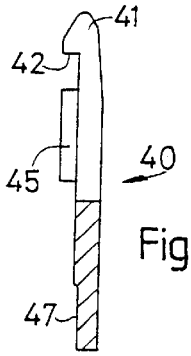
Fig. 6
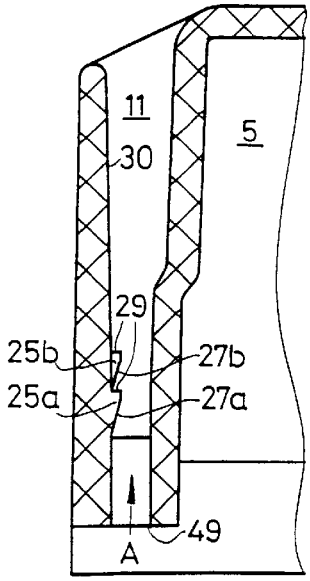
Fig. 4
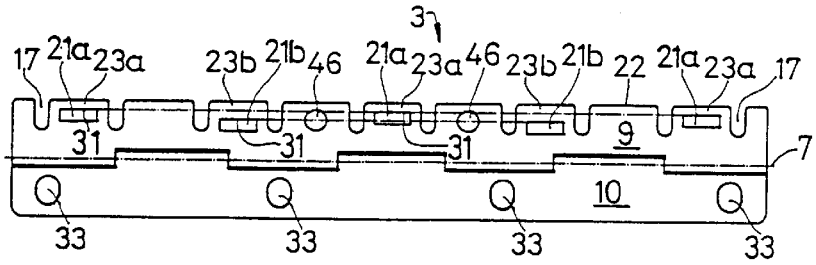
Fig. 2
Fig. 3
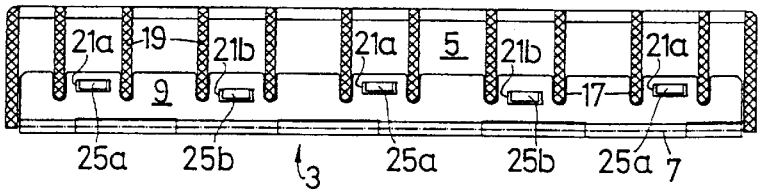
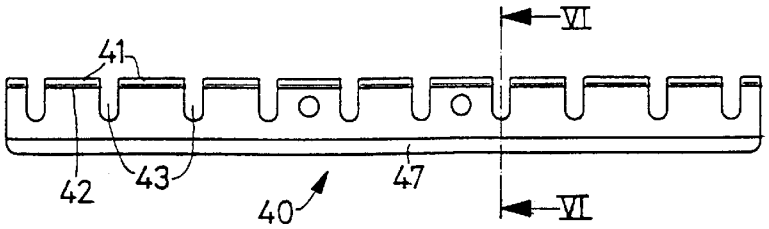
Fig. 5

Fig. 9
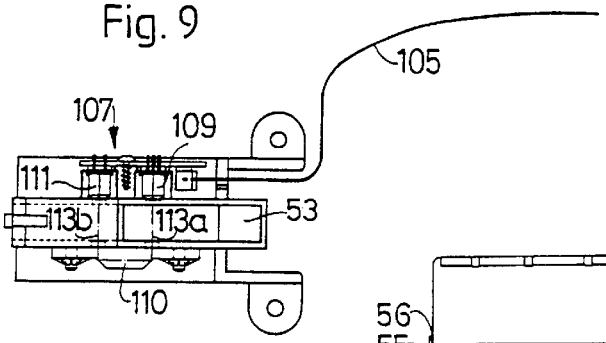
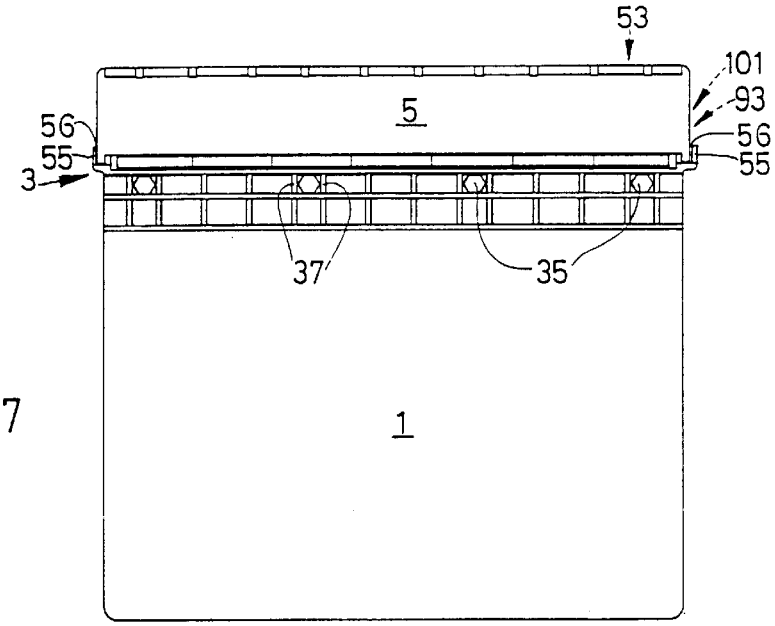
Fig. 7
Fig. 8
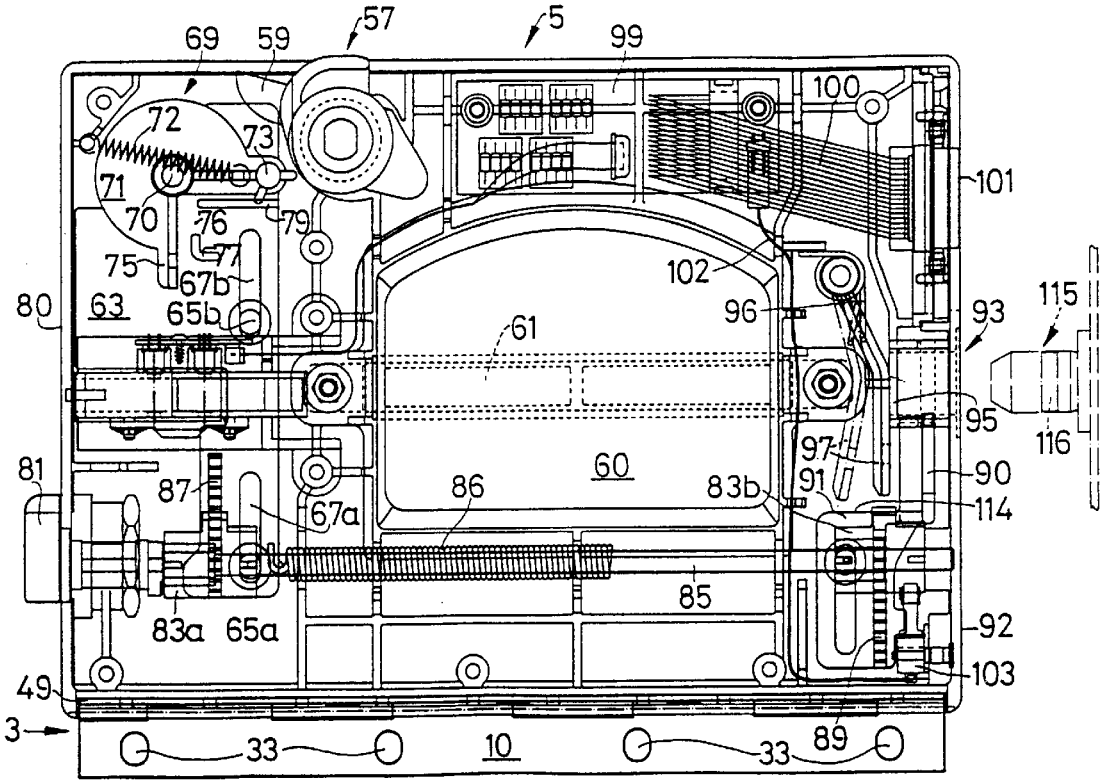

DEVICE WITH A SWIVELLING WING, ESPECIALLY CONSTRUCTED AS A COIN-ACCEPTING DEVICE IN A SELF-COLLECTING VENDING MACHINE

The invention concerns a device having a base element and a wing arranged on the base element pivotable with a swivel joint, particularly on constructed as a coin-accepting device in a self-collecting vending machine.

STATE OF THE ART

There are the most frequent constructions with which swivelling wings can be arranged on a base element. As a rule, a hinge frame whose two lateral bands are screwed on the base element and the wing is used. In addition to this hinge frame, compact hinges with a pin to be fastened on the respective component are also provided. The familiar hinges require time to install and are as a rule not protected against unauthorized disassembly.

OBJECT OF THE INVENTION

The object of the invention is to create a device with a base element and a wing arranged pivoting on the base element with a swivel joint, in connection with which the swivel joint can be rapidly installed in a simple manner, but cannot be removed without visible destruction. Owing to this destruction, manipulations which are performed in connection with an unauthorized opening on the swivel joint are easily recognizable at all times.

A further object of the invention is to create a coin-accepting device for a self-collecting vending machine which can be economically produced while observing the necessary safety measures against unauthorized removal of money.

ACCOMPLISHING THE OBJECTIVE

The configuration and arrangement of the swivel joint for accomplishing the above-mentioned objectives preferably contributes to the economic production of a coin-accepting device while observing necessary safety measures against unauthorized removal of money. The swivel joint described here is preeminently suitable in connection with a box-like coin-accepting device, and can also be used with other devices where no safety measures against unauthorized removal of the contents must be observed. The swivel joint can be configured in the form of a hinge plate. Compact constructions can also be analogously created, however.

In addition to the coin-accepting devices just mentioned, consoles, casements in window frames, doors in door frames, housing doors etc. can be constructed this way.

In contrast with the known ways offastening swiveljoints with screws or rivets, the invention uses holding elements which snap in which, as described below, can be simply pushed together, but can no longer be separated without destruction. This impossibility of disassembly is an advantage wherever manipulations should be immediately visible, as with the transport of money.

Further areas of use and construction variants emerge from the text below.

EMBODIMENTS OF THE INVENTION

Examples of the device of the invention will be explained in greater detail below. Further advantages of the invention become clear from the following descriptive text, wherein:

FIG. 1 Depicts a cross section through the swivel joint of the device of the invention, FIG. 2 Plan view of a swivel joint constructed as a hinge plate of the device represented in FIG. 1 as a separate component, FIG. 3 A longitudinal section through the swivel joint of the device represented in FIG. 1, FIG. 4 A cross section through a wing kept pivotable with the swivel joint constructed as a cover of the device represented in FIG. 1, FIG. 5 A plan view of a filler element as separate component of the swivel joint represented in FIG. 1, FIG. 6 A cross section along line VI—VI in FIG. 5 of the filler element shown there in enlarged representation, FIG. 7 A back view of the device represented in FIG. 1, constructed as a coin-accepting device, FIG. 8 An internal view of a cover of the coin-accepting device represented in FIG. 7, and FIG. 9 A view toward a coin inflow control arranged in the cover interior.

The device of the invention represented with a cross section has a base element 1 of which only the upper rim area 2 is depicted here, and a wing 5 arranged pivotably with a swivel joint 3 on the base element 1. The device can, for example, be a coin-accepting device as described here as it finds use in a self-collecting vending machine. The wing 5 is here constructed as a cover which is likewise described below with its particularities together with the coin-accepting device.

The swivel joint 3 is constructed with a swivel axis 7 as a hinge plate. One attachment flange 9 and 10 each running parallel to the pivoting axis 7 is arranged on both sides of the pivoting axis 7, as can be seen especially in FIG. 2. The fastening flange 9 is permanently snapped into a slot 11 in the reverse long side of the cover 5. The other fastening flange 10 is screwed in in the upper rim area 2 of the reverse side 16 of the base element.

The flange 9 has slot-like recesses 17 set at an equal distance running parallel to the pivoting axis 7 which run from its outer long side to the pivoting axis 7. The length of the recesses is selected such that the material element remaining in the flange 9 is sufficient for flange stability. The width of the recesses 17 is selected such that they can be pushed over the louvered slide connections 19 in the slot 11 of the cover 5. These louvered slide connections 19 are configured as connecting walls running parallel to and equidistant from each other, as represented in cross section in FIG. 3. The louvered slide connections 19 serve to stabilize the slot 11. They merely permit an elastic "bending" of the louvered slide areas to guarantee the snap in process described below, but do not allow any introduction of an object for bending the louvered slide areas and therewith for opening the "snap mounting."

The holding elements of flange 9 are constructed as openings 21*a* and 21*b* with a square-shaped contour and the associated respective bar 23*a* or 23*b*. The hinge plate 3 represented as a separate component in FIG. 2 (as, for example, a embodiment of the swivel joint) has three openings 21*a* and two openings 21*b*. The openings 21*a* as well as the openings 21*b* are in any given case at an equal distance from the outside long edge 22 of flange 9, whereby, however, the distance between the openings 21*a* is smaller as that between openings 21*b*. Bars 23*a* and 23*b* with two different widths lie between openings 21*a* and 21*b* and the outer long edge 22. Bars 23*a* and 23*b* are arranged in analogous distance to the openings 21*a* and 21*b* on one of the interior walls of the slot 11 in the cover 4, as can be seen in FIGS. 3 and 4. Each of the bars 25*a* and 25*b* has an inclined inlet area 27*a* or 27*b* and a bar edge 29 dropping vertically toward the inner wall 30. This inner bar edge 29 comes to lie on the inner bar edge of bars 23*a* or 23*b* in connection with the state where the flange 9 is pushed and snapped into the slot 11, as represented in FIG. 2.

Flange 10 has here, for example, a flange width corresponding to that of flange 9 and four openings 33 constructed as long holes. Screws, as represented in FIG. 1 for a single one, are inserted through these openings 33 for fastening it at the upper rear rim area 2 of the base element 1. The hexagonal screwhead 35 of reach screw 34 rests in a projecting edging 37 arranged on the exterior of the rim area. The edging is constructed narrow such that the screw 34 is insertable from the exterior, and when the screw 34 is inserted, the screw head 35 can no longer be rotated, nor can any tool be applied. The nuts 39 are then screwed on to the screws 34 to attach the flange 10 in the interior of the base element 1. The attachment of the flange 10 is selected here so as to be secured from unscrewing from the outside as the device, for example, is supposed to serve as a coin-accepting device. The interior is protected by the cover 5 described below and its secured locking mechanism. Through this type of fastening of the flange, an unauthorized opening of the device is made difficult: In particular, an unauthorized opening should only be possible through mechanical destruction which is then immediately recognizable. If no security measures are necessary and if the hinge should only be capable of rapid and simple installment, it is possible to dispense with the special mode of attachment with laterally clamped screw heads described here.

In the embodiment described here, the cover 5 is made of plastic and the hinge plate 3 of metal. The flanges 9 of the hinge plate 3 consequently have a material thickness of approximately one millimeter (more or less). To produce a fastening on the cover 5, the flange 9 should be inserted into the slot 11 described above. That means, in order to guarantee a good hold, the slot 11 should likewise be constructed approximately in this width of about a millimeter. Production of slots this narrow with a plastic injection process is, however, expensive and difficult. One could now thicken the flange 9 by welding on a band adapted to this, which would, however, require a rather great expenditure of work.

In a particular embodiment of the invention, we have taken another approach. An injected filler element 40, preferably of plastic, is simply applied to the flange 9. This filler element 40 is represented inserted in FIG. 1 and as a separate component in plan view in FIG. 5, and in FIG. 6 in enlarged cross section along line IV–VI in FIG. 5. The filler element 40 has a hook-like locating rail 41, the inner edge of which os laid on the exterior long edge 22 of flange 9. Analogous to the recesses 17 of flange 9, the filler element 40 also has recesses 43. Furthermore, the filler element 40 has two projecting circular nubs 45 which are adapted to two circular openings 46 in flange 9. The thickness of the filler element 40 is adapted to a well injectable width of the slot 11 and the height to the width of the flange 9. The material attenuation 47 on the end opposite the locating rail 41 simply has its justification in the injection molding process used.

For installing the hinge plate 3, the filler element 40 is placed on the flange 9 such that the nubs 45 lie in the openings 46. The hinge plate 3 is then pushed in together with the filler element 40 in direction A through the internal slot opening 49. The locating rail 41 of the filler element 40 together with the exterior long edge 22 of the fastening flange 9 first slide over the inlet surfaces 27*a* and only subsequently over the post-positioned inlet areas 27*b*. If both parts are completely pushed in, the corresponding bars 25*a* and 25*b* lie in the openings 21*a* and 21*b*. A subsequent withdrawal is no longer possible owing to the sawtooth-like elevations. Through this post-positioning of the inlet surfaces 27*a* after the inlet surfaces, there exists a reduction of the slide-in force.

As a consequence of the post-positioning of inlet surfaces 27*a*, not only the slide-in force is diminished. There hereby results a security advantage against disassembly of this connection. A violent pushing in of a narrow object along the interior wall 30 for attempted disassembly can succeed only in connection with a single bar arrangement. The adjacent bar arrangement has then again another distance from the outer edge. In an attempt to dismantle it, the remaining bar arrangements then always engage.

Instead of constructing the one flange by means of sawtooth-like elevations 25*a* and 25*b* which engage in openings 21*a* and 21*b*, sawtooth-like elevations can also be used on both sides. Instead of openings 21*a* and 21*b*, corresponding depressions can also be used. The sawtooth-like elevations can also be arranged on the flap 9 and the depressions on the louvered slide 30. With regard to manufacturing, it is, however, simpler to arrange the openings or depressions on the flange. Instead of holding only the one flange with a snap connection, both flanges can also be held in this way.

Owing to the simple installability and the impossibility of disassembly, the swivel joint described above is preferably used in connection with a coin-accepting device as it is in particular used in self-collecting vending machines. As has already been explained, this use is not mandatory. The construction of an appropriate swing device is possible almost without restriction in all areas of application.

A coin-accepting device is used everywhere regularly filled coin containers must be replaced by empty ones. The full containers are brought to a central office where they are then opened by authorized personnel and emptied. The coin-accepting should be designed such that it is resistant to opening manipulations during transport. That a transporter can withdraw a portion of the stored coins for his personal enrichment should especially be prevented. The coin accepting device must not necessarily withstand an application of brute force. Any use of force to press forward to the coin content should, however, be well visible. The transporter is finally known and the monetary content not so large that it would be profitable for the transporter to disappear.

The device constructed as a coin-accepting device is represented in FIG. 7 in a rear view with a view of the swivel joint 3. It has a base element I which merely serves to accept coins and a swivelling cover 5, the pivotability of which is protected by the security measures described below. Base element 1 and cover 5 are made of plastic in an injection molding process. So-called high quality plastics with a high rigidity and impact resistance, as, for example, modified polyester, are used. Good results were also attained with reinforced mixed products, especially with polyamide 66, 61 and 12.

Coin input takes place through a closable opening 53 in the cover 5. All mechanical elements necessary for the closing process as well as all electrical control, monitoring and/or machine coding element are arranged in the cover 5. The base element 1 is merely a passive container. The base element 1 has an upper groove-like rim 55 running around on the front and both side walls. The upper rim of the cover 5 engages into this groove 56. A plying up or a light bending up of the cover to "fish out" coins is consequently impossible without visible destruction.

The cover 5 is closable through a lock constructed as a cylinder lock 57 arranged in it, whose cylinder (not represented) is connected with a locking bar 59. The locking bar 59 engages in a recess (not represented) in the front side wall of the base element 1 in the locked position. An inwardly formed-out grip basin 60 with a carrying grip 61 is present on the cover upper side.

The coin drop opening 53 is closable with a shutter 63. The shutter 63 has two guides with long holes 67*a* and 67*b* into which guide pins 65*a* and 65*b* engage. In FIG. 8, a mechanical "flip-flop" element 69 is arranged to the left alongside the lock 57.

The mechanical "flip-flop" element 69 has a toggle lever 71 rotatable about an axis 70 which stands under the action of a tension spring 72. The tension spring 72 lies above or below the axis 70 according to the position of the mechanical "flip-flop" element 69. The toggle lever 71 is then held in the appropriate position by the tension spring 72. The toggle lever 71 has a pin 73 projecting parallel to the axis 70 and an extension 75. The extension interacts with a free space 76 formed by a projecting angle plate 77 and a projecting bar 79, Angle plate 77 and bar 79 are components of the shutter 63. A manual control button 81 passing through the cover side wall 80 is coupled with both gear wheels 83*a* arranged adjacent to the cover interior side walls. The manual control button 81 can be replaced by a key switch for heightened security.

Both gear wheels 83*a* and 83*b* are connected by an axle 85 prestressed with a torsion spring 86. The gear wheel 83*a* meshes with a spur rack 87 arranged on the shutter 63. The gear wheel 83*b* likewise meshes with a spur rack 89 which is arranged on a slide bar 91 sliding a latch 90. The latch 90 is moveable crosswise in a partial opening area of a hub 93 extending through the cover side wall 92. A lever swivellable inwardly against the tension of a spring 96 lies in front of the internal hub opening 95.

An electrical printed circuit 99 is arranged in FIG. 8 above (in the picture) the grip basis 60 (located to one side) which is connected with a plug 101 kept floating in the cover side wall 92 above a flat belt cable. The plug 101 is constructed floating so that it can be introduced self-adjusting in a plug suitable for this in the vending machine. The printed circuit 99 bears an electronic coding for the relevant coin-accepting device for its identification. The printed circuit 99 is furthermore connected with a circuit relay 103 through a two-stranded cable 102 which monitors the rotating position of the gear wheel 83*b*. The rotating position of the gear wheel 83*b* indicates the position of the manual control button 81 and therewith also the closure or open position of the coin drop opening as well as the removal release of the coin-collecting device or its locking in the vending machine.

The printed circuit 99 is furthermore connected with the coin counting device 107 represented in enlargement in FIG. 9 through a further cable 105. The coin counting device 107 has a ray-emitting diode 109 on one side of the coin drop opening 53, a ray deflection prism 110 on the other side of the coin drop opening 53 as well as a radiation detector 111 alongside the diode 109. The two rays 113*a* and 113*b* crossing the opening 53 are at a distance from each other. The distance is selected such that even the smallest coin diameter will interrupt at least one of the two rays so that each coin actually introduced is also counted. The degree that the container 1 is filled is inferred from the number of coins 53 which have fallen through the opening. An inexactitude called forth by coins of different cross section is hereby taken into account.

If the coin-accepting device is used in a self-collecting vending machine (not represented), then a bolt 115 (not represented) reaches through the hub 92. The bolt 115 has a transverse slot 116 perpendicular to its long axis running through the slide bar 91. The coin-accepting device is hereby fixed in the vending machine. The plug 101 is connected with a vending machine plug (nor represented). The shutter 63 is moved in the direction of the printed circuit 99. The coin drop opening 53 is open. The toggle lever 71 lies with its extension 75 on the angle plate 77.

Should the coin-accepting device be removed from the vending machine, then no key functions are to be operated. The manual control button 81 is rotated to the left by means of which the shutter 63 is moved in the direction toward the swivel joint 3 (away from the printed circuit 99) when closing the coin drop opening 53. The extension 75 locks in the free space 76 and lies on bar 70 and on the angle plate 77. The slide bar 91 is withdrawn from the notching of the bolt of the vending machine. The lever stands with its front edge on an edge 114 of the slide bar 91. Even by pressing an object into the hub 92 and pushing the lever 97 away, the coin drop opening 53 cannot be opened to "shake out" coins.

By introducing an appropriate key into lock 57 and rotating it, there results a swinging of the locking bar 59 in the direction toward the swivel joint 3. This way, the extension 75 of the mechanical "flip-flop" element 69 is brought out of the free space 76. The cover 5 can be swivelled and the coins can be removed from the container. The mechanical "flip-flop" element 69 is already in the right position for successive operating sequences. It remains in this position even after closing the cover 5. If the coin-accepting device is inserted into the vending machine, then the bolt reaching through the hub 92 pushes the lever 97 toward the interior through which this slides away from the edge 114 and releases the sliding bar 91. Since no further locking is available, the shutter 53 and even the sliding bar 91 are pushed by the force of the stressed torsion spring 86 over the gear wheels 83*a* and 83*b* as well as spur racks 87 and 89 in the direction of printed circuit 99. The coin drop opening 53 is open again and the coin-collecting device is locked with the bolt of the vending machine.

What is claimed is:

1. A device comprising:

a base element;

a wing;

and a swivel joint including a pivoting axis and first and second fastening flanges swivellable about the pivoting axis mountable on the base element or on the wing so that they are pivotable, wherein the base element and the wing each include at least one free rim side, and at least one of the base element and the wing includes in said rim side a slot adapted to one of said fastening flanges, wherein the first fastening flange is fastenable inside said slot of one of said base element and said wing, and the second fastening flange is fastenable to the free rim side of the other of said base element and said wing, wherein the second fastening flange includes at least one first and one second snap-in holding element, wherein at least one first and one second snap-in holding counter elements are arranged inside said slot, wherein said snap-in holding elements and said snap-in holding counter elements being constructed for snapping inseparably together when said second fastening flange is pressed into said slot by an application of force in a fastening plug-in direction, so that the swivel joint can be rapidly installed in a simple manner and said second fastening flange is permanently connectable to said slot, wherein the at least one first snap-in holding element and the at least one first snap-in counter holding element are arranged at a first distance from said pivoting axis and said rim side, respectively, wherein at least one second snap-in holding element and the at least one second snap-in counter holding element are arranged at an second distance from said pivoting axis and said rim side, respectively, and wherein said first and second distances being different, so that after having been pressed into said slot, said second fastening flange cannot be removed from said slot without causing visible destruction to said free rim side, such that disassembling of the swivel joint by sliding a flat object between said snap-in holding elements and snap-in counter holding elements is not possible after said second fastening is pressed into said slot.

2. The device according to claim 1, wherein all snap-in holding elements and snap in counter holding elements have at least one bar running crosswise to the fastening plug-in direction, wherein the arrangement of the bars is such that, after the second fastening flange is pressed into said slot, an inner edge of each bar corresponding to a snap-in holding element comes to lie adjacently inseparable with an inner edge of a bar corresponding to a snap-in holding counter element, up to a given tolerance.

3. The device according to claim 2, wherein the first or second counter holding elements are constructed on one of the two walls forming the slot, wherein louvered slides connections connecting the two walls are arranged perpendicular to the fastening plug-in direction for stabilizing the slot, and the second fastening flange has recesses adapted to the louvered slide connections.

4. The device according to claim 2, constructed as an interchangeable coin accepting device of a self-collecting vending machine wherein the base element is configured as a container accepting the coins and a cover closing the container, and the wing is configured as a locking device, and wherein all moving mechanical elements necessary for a locking process as well as all electronic control, monitoring, and/or device coding elements are arranged in the cover, and the container is merely constructed as a passive component.

5. The device according to claim 1, constructed as an interchangeable coin accepting device of a self-collecting vending machine wherein the base element is configured as a container accepting the coins and a cover closing the container, and the wing is configured as a locking device, and wherein all moving mechanical elements necessary for a locking process as well as all electronic control, monitoring, and/or device coding elements are arranged in the cover, and the container is merely constructed as a passive component.

6. The device according to claim 5, wherein the cover has a coin admission facility with a coin counting facility so that the degree of filling the container with coins can be inferred on the basis of the coins counted.

7. The device according to claim 6, wherein at least one of the container and the cover is made of plastic.

8. The device according to claim 7, wherein at least one of the container and the cover is made of a modified polyester.

9. The device according to claim 7, wherein at least one of the container and the cover is made of a polyamide.

10. The device according to claim 5, wherein at least an electric plug is arranged in a cover rim for signal and/or energy transmission for the electrical control, monitoring and/or device coding elements.

11. The device according to claim 10, wherein at least one of the container and the cover is made of plastic.

12. The device according to claim 11, wherein at least one of the container and the cover is made of a modified polyester.

13. The device according to claim 11, wherein at least one of the container and the cover is made of a polyamide.

14. The device according to claim 5, wherein at least one of the container and the cover is made of plastic.

15. The device according to claim 14, wherein at least one of the container and the cover is made of a modified polyester.

16. The device according to claim 14, wherein at least one of the container and the cover is made of a polyamide.

17. The device according to claim 1, wherein the first or second counter holding elements are constructed on one of the two walls forming the slot, wherein louvered slides connections connecting the two walls are arranged perpendicular to the fastening plug-in direction for stabilizing the slot, and the second fastening flange has recesses adapted to the louvered slide connections.

18. A device comprising:

a base element;

a wing;

and a swivel joint including first and second fastening flanges swivellable about a pivoting axis mountable on the base element or on the wing so that they are pivotable, wherein the base element and the wing each include at least one free rim side, and at least one of the base element and the wing include in said rim side a slot with side walls adapted to the thickness of one of said fastening flanges, wherein said first fastening flanges is fastenable to the free rim side, and the said second fastening flange is fastenable inside said slot, wherein the second fastening flange includes at least one first and one second snap-in holding element, wherein at least one first and one second snap-in holding counter elements are arranged inside said slot, wherein said snap-in holding elements and said snap-in holding counter elements being constructed for snapping inseparably together when said second fastening flange is pressed into said slot by an application of force in a fastening plug-in direction, so that the swivel joint can be rapidly installed in a simple manner and said second fastening flange is permanently connectable to said slot, wherein said slot includes at least one louvered slide connection connecting said two side walls and lying perpendicular to the fastening plug-in direction between said first and second snap-in holding counter elements, wherein said second fastening range includes at least one recess between said first and said second snap-in holding elements, said at least one recess arranged to surround said at least one louvered slide connection, such that said at least one louvered slide connection stabilizes the slot against elastic bending and guarantees that the no object can be entered between the snap-in holding elements after the second fastening flange is pressed into said slot.

19. The device according to claim 18, constructed as an interchangeable coin accepting device of a self-collecting vending machine wherein the base element is configured as a container accepting the coins and a cover closing the container, and the wing is configured as a locking device, and wherein all moving mechanical elements necessary for a locking process as well as all electronic control, monitoring, and/or device coding elements are arranged in the cover, and the container is merely constructed as a passive component.

* * * * *